United States Patent [19]

Herfeld

[11] 4,372,686

[45] Feb. 8, 1983

[54] DOUBLE-CONE ROTATING MIXER

[76] Inventor: Friedrich W. Herfeld, Wall 1, 5982 Neuenrade, Fed. Rep. of Germany

[21] Appl. No.: 265,372

[22] Filed: May 20, 1981

[51] Int. Cl.[3] ..... B01F 9/02

[52] U.S. Cl. ..... 366/220; 366/232; 366/235

[58] Field of Search ..... 366/213, 214, 220, 232, 366/233, 235, 54, 56, 197, 200, 207, 208, 209

[56] References Cited

U.S. PATENT DOCUMENTS

| | | | |
|---|---|---|---|
| 2,652,983 | 9/1953 | Hall | 366/220 |
| 2,841,370 | 7/1958 | Cosmetto | 366/232 |
| 3,137,327 | 6/1964 | Muench | 366/220 |
| 3,188,058 | 6/1965 | Locke | 366/235 |
| 3,224,741 | 12/1965 | Muench | 366/197 |
| 3,229,694 | 1/1966 | Koropp | 128/510 |
| 3,638,923 | 2/1972 | Pommier | 366/220 |
| 3,699,786 | 10/1972 | Rencher | 366/220 |
| 4,004,783 | 1/1977 | Wilson | 366/200 |

FOREIGN PATENT DOCUMENTS

| | | |
|---|---|---|
| 563600 | 10/1932 | Fed. Rep. of Germany . |
| 1444466 | 2/1969 | Fed. Rep. of Germany . |
| 1279654 | 6/1969 | Fed. Rep. of Germany . |
| 1330444 | 5/1963 | France . |
| 1393602 | 2/1965 | France . |
| 995661 | 6/1965 | United Kingdom . |

*Primary Examiner*—Robert W. Jenkins
*Attorney, Agent, or Firm*—Joseph A. Geiger

[57] ABSTRACT

A rotating mixer with a double-cone mixing vessel carried by a horizontal mixer spindle, the mixing vessel consisting of two identical half-vessels which are releasably clamped to a central spindle ring. The opening of the spindle is closable by means of a pivotable shutoff clappet, when the charged half-vessels are attached or released using a dolly and lifting jack. Separate pairs of half-vessels can be used for mixing charges of different composition.

6 Claims, 6 Drawing Figures

DOUBLE-CONE ROTATING MIXER

BACKGROUND OF THE INVENTION

1. Field of the Invention

The present invention relates to a rotating mixer having a mixing vessel of double-cone shape which is rotatable about a horizontal rotational axis in perpendicular alignment with the vessel axis.

2. Description of the Prior Art

In known rotating mixers of this type, the mixing action takes place as a result of a free fall of the charge components inside the rotating mixing vessel. This mixing action does not require the direct application of mixing energy, as in a stir-type mixing action. For this reason, a double-cone rotating mixer is frequently the preferred type of mixer.

The double-cone mixing vessel has openings for charging and discharging which must be maintained in an exact position, when the mixing vessel is manipulated. Because of the comparatively small size of these charge and discharge openings, it is not practical to clean the inside of the double-cone mixing vessel. On the other hand, cost considerations make it uneconomical to use sectioned mixing vessels which can be dismantled for cleaning. It follows that problems are encountered whenever mixing charges of different composition are to be processed in the same double-cone mixer, due to the possibility of contamination of a mixing charge with residue from a preceding charge.

SUMMARY OF THE INVENTION

It is an objective of the present invention to provide an improved double-cone rotating mixer which facilitates the cleaning of the mixing vessel so that mixing charges of different composition can be processed, without the risk of contamination from preceding charges.

The present invention proposes to attain this objective by suggesting an improved double-cone rotating mixer which includes the following novel features:

(a) the mixer spindle carries a spindle ring;

(b) the spindle ring has two end faces which serve as mounting faces, in cooperation with quick-release clamping devices;

(c) the ring opening is closable by means of a shutoff clappet which is pivotable about a central transverse axis; and (d) the mixing vessel consists of two half-vessels, each having a tapered bottom section and an open top with an attachment flange with which it is clampable to a mounting face of the spindle ring.

Accordingly, the invention suggests two separate and independent manipulatable half-vessels. Even half-vessel has a large open top side which greatly facilitates the charging of the vessel. A simple vessel transfer device serves to join the charged half-vessels to the spindle ring of the rotating mixer. Once the two half-vessels are clamped to the spindle ring, they form a single double-cone mixing vessel supported by the mixer spindle which, when driven, performs the mixing operation in a known way. Upon completion of the mixing process, the half-vessels vessels are separately released from the spindle ring and transferred to their intended point of use.

By making it possible to remove the half-vessels from the spindle ring and thereby separating the double-cone vessel into two independently transportable receptacles with bottom discharge openings, the invention makes it possible to utilize these receptacles as transfer receptacles, storage receptacles, and/or charging receptacles, so that the operational steps which precede and follow the mixing operation can be greatly simplified. The separate half-vessels can also be utilized as on-site receptacles, or as charging receptacles for a subsequent processing step.

The fact that each half-vessel has a large unrestricted opening at its upper end greatly facilitates any cleaning that may be necessary. For successive mixing charges of different composition, it is also possible to provide separate pairs of half-vessels, so that a contamination of one charge with residue from another charge is not possible. Accordingly, the present invention results in a surprising improvement in the cleaning process and an increase in the versatility of the double-cone rotating mixer whose half-vessels can be used for additional process steps, as mentioned.

Additional novel features of the invention are specified in the dependent claims.

BRIEF DESCRIPTION OF THE DRAWINGS

In the following, a preferred embodiment of the invention will be described in greater detail, with reference to the accompanying drawings, which show the embodiment in the various figures as follows.

DESCRIPTION OF THE PREFERRED EMBODIMENT

Figure 1:
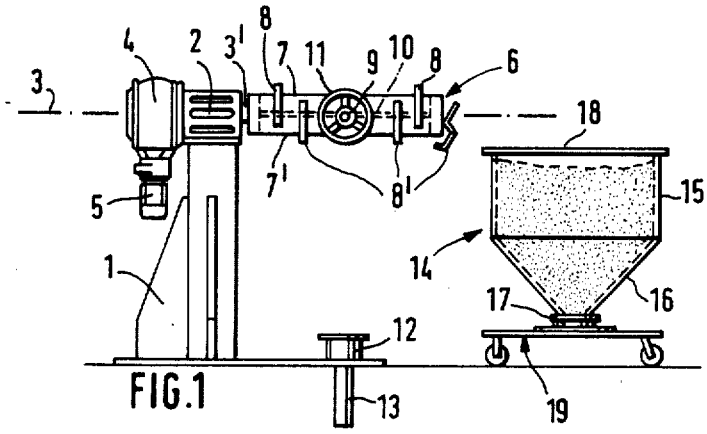
FIG. 1 shows, in a somewhat schematic representation, the double-cone rotating mixer embodying the invention, one of its half-vessels being ready for attachment.

The double-cone rotating mixer of the invention, as shown in FIGS. 1–6, comprises a vertical console 1 in the form of a sturdy braced column which supports the mixer assembly. On top of the mixer console 1 is mounted a spindle bearing 2 which supports the mixer spindle 3' defining a horizontal rotational axis 3. The mixer spindle 3' receives its drive from a gear assembly 4 and a connected motor 5. The free extremity of the mixer spindle 3' has attached to it a spindle ring 6 in an orientation in which the rotational axis 3 of the mixer extends radially through the center of the ring 6. The spindle ring 6 has two end faces which serve as oppositely oriented identical mounting faces 7 and 7'. On the periphery of the spindle ring 6 are further arranged two sets of quick-release clamps 8 and 8' which are associated with the mounting faces 7 and 7', respectively.

The spindle ring 6 further carries a clappet shaft 9 which likewise extends radially through the center of ring 6, intersecting the rotational axis 3 at a right angle. The clappet shaft 9 serves as a pivot for a shutoff clappet 10 in the form of a circular plate which is attached to shaft 9. A handwheel 11, or some other suitable control means, serves to rotate the clappet shaft 9 and its shutoff clappet 10 over an angle of close to 90°. The mounting faces 7 and 7' on the spindle ring 6 include on their inner sides appropriate annular recesses which serve as sealing faces for the shutoff clappet 10.

Centrally below the spindle ring 6 is arranged a lifting jack 12 with a drive in the form of a hydraulic or pneumatic cylinder 13.

Figure 4:
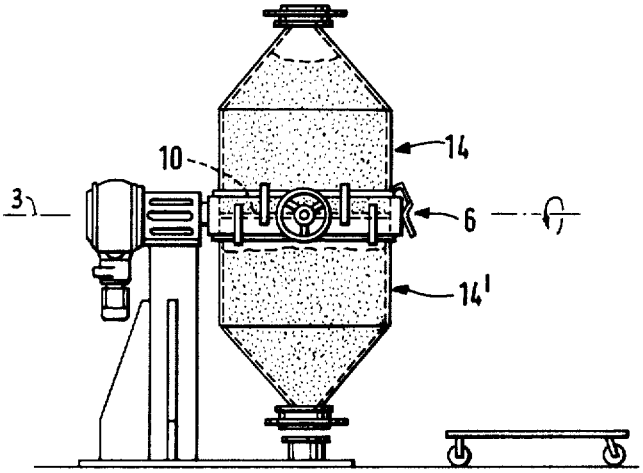
FIG. 4 shows the fully assembled and charged double-cone mixer of the invention.
Figure 6:
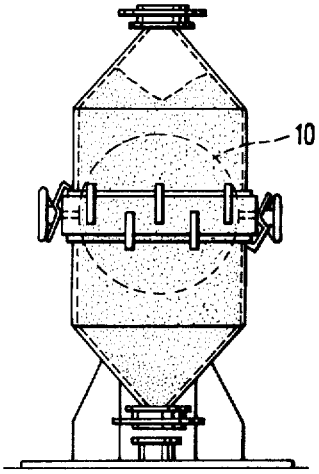
FIG. 6 shows the mixer of FIG. 5 in a side view.

The vessel of the double-cone rotating mixer of the invention consists of two half-vessels 14 and 14'. Each half-vessel has the form of an upwardly open container with a cylindrical main section 15 and a tapered bottom section 16. The tapered bottom section 16 includes a discharge device 17, preferably in the form of a valve-closable discharge opening. On the upper extremity of the half-vessel 14 has a peripheral attachment flange 18 which is adapted to cooperate with the mounting face 7 or 7' of the spindle ring 6. The mixer station further includes a dolly 19 for the support and transfer of the half-vessel 14 or 14'. The two half-vessels 14 and 14' are thus attachable to opposite sides of the spindle ring 6, as can be seen in FIG. 4, thereby forming a single double-cone mixing vessel.

Figure 2:
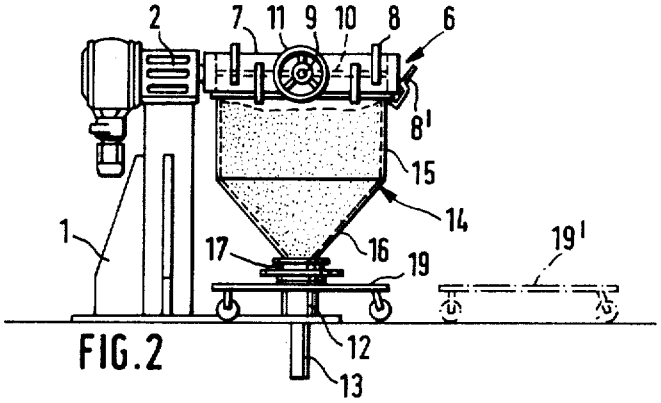
FIG. 2 shows the mixer components of FIG. 1 in a position in which the first half-vessel is being attached to the spindle ring of the mixer.
Figure 3:
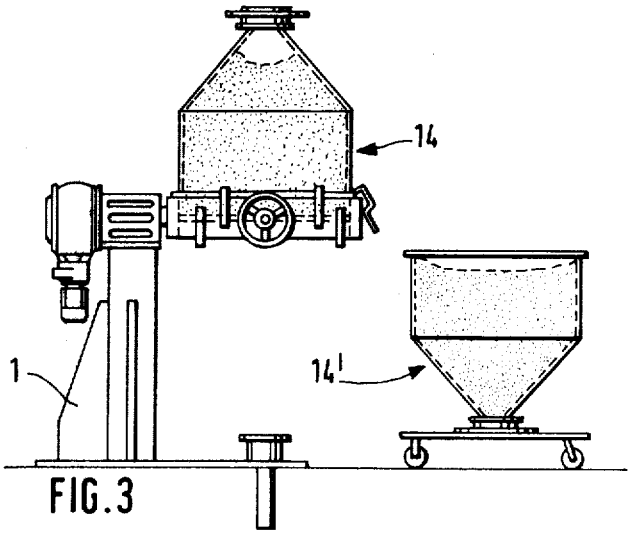
FIG. 3 shows the mixer components of FIGS. 1 and 2 in a position in which the mixer is ready for the attachment of the second half-vessel.

The operation of the double-cone mixing vessel of the invention is as follows:

The spindle ring 6 is held in its horizontal rest position, as shown in FIG. 1. The first half-vessel 14 has been filled with mixing components and, resting on the dolly 19, is wheeled towards the mixer console 1. Following positioning of the dolly 19 underneath the spindle ring 6, the half-vessel 14 is lifted by means of the lifting jack 12, as shown in FIG. 2, until its attachment flange 18 comes into contact with the mounting face 7' of the spindle ring 6. Using the quick-release clamps 8', the half-vessel 14 is attached to the spindle ring 6. Now the lifting jack 12 is lowered and the dolly 19 is removed to its position 19', shown in stippled lines.

Figure 5:
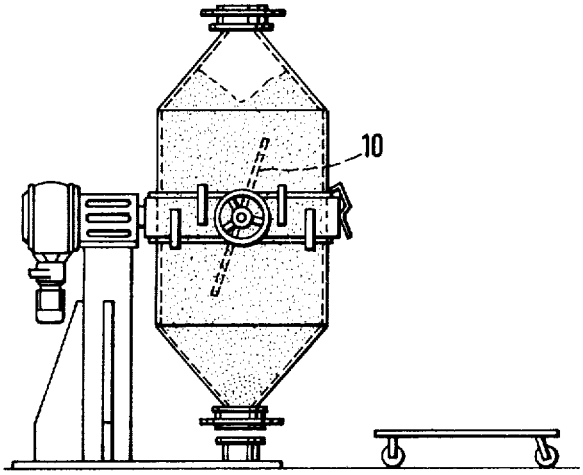
FIG. 5 is similar to FIG. 4, showing the double-cone mixer in ready-position for the mixing process.

The half-vessel 14 being carried by the mixer spindle 3', the latter can now be rotated about its rotational axis 3 by an angle of 180°. The shutoff clappet 10 which covers the entire opening of the spindle ring 6, prevents the contents of the half-vessel 14 from flowing out. The second half-vessel 14' is now wheeled to the mixing station. As in the case of the first half-vessel 14, the second half-vessel 14' is raised against the spindle ring 6 by means of the lifting jack 12, for clamping attachment to the mounting face 7 by means of the quick-release clamps 8. Then the lifting jack 12 is lowered and the dolly 19 is removed. Both half-vessels 14 and 14' are now firmly attached to the spindle ring 6, forming a double-cone mixing vessel, as can be seen in FIG. 4. Finally, the shutoff clappet 10 is rotated by an angle of close to 90° by rotating the clappet shaft 9, so that the clappet 10 assumes an open position, as shown in FIG. 5. The double-cone mixing vessel is now ready for rotation about its axis 3. This rotation produces a mixing action of the mixing components, using the free-fall energy of the mixer vessel contents. The slightly inclined orientation of the shutoff clappet 10 enhances the mixing action. The mixing components are treated gently.

At the completion of the mixing process, the shutoff clappet 10 is returned to its closed position and the mixing spindle is stopped in the horizontal rest position of the spindle ring 6. Now, the lower half-vessel can be released onto the lifting jack 12, by opening the quick-release clamp 8, whereupon the half-vessel 14 is deposited on the dolly 19 for removal. The second half-vessel is similarly released and removed, following rotation of the spindle ring 6.

The spindle ring 6 presents no cleaning problems. Only a small transition area between the mounting faces 7 and 7' is in contact with the mixing components. This transition area is preferably no more than a sealing rim. In any case, this transition area is easy to clean. The half-vessels are preferably used for identical mixing components only, so that they necessitate cleaning at longer intervals only. When different mixing components are to be processed, it is preferable to use different pairs of mixing vessels, so that intermingling or contamination by different charge components is made impossible.

As an alternative to the lifting device 12, it is also possible to make the mixer console vertically extendable or othewise vertically movable, for the purpose of raising and lowering the half-vessels 14 and 14' during assembly and disassembly.

It should be understood, of course, that the foregoing disclosure describes only a preferred embodiment of the invention and that it is intended to cover all changes and modifications of this example of the invention which fall within the scope of the appended claims.

I claim the following:

1. Double-cone rotating mixer, the double cone mixing container of which is rotatable about a horizontal rotational axis, aligned at a right angle to the container axis, characterized by the following features:

(a) the mixer spindle (3') carries a ring (6);

(b) the ring (6) possesses on its front faces two ring clamping areas (7,7') with clamping devices (8,8');

(c) a closing valve (10), adapted to the inner cross-section of the ring, is pivotable about a swivelling axis (9);

(d) two half containers (14,14') each comprising a contact surface (18), suited for one of the ring clamping areas (7,7'), as well as a conical bottom part (16).

2. Double-cone rotating mixer according to claim 1, characterized by a lifting device (12) for said half container.

3. Double-cone rotating mixer according to one of claims 1 or 2, characterized in that the ring (6) is supported on the mixer spindle (3') in a cantilevered arrangement.

4. Double-cone rotating mixer according to claim 1, characterized in that the closing valve (10) is pivotable over an angle of almost 90°.

5. Double-cone rotating mixer according to claim 1, characterized in that the swivelling axis (9) of the closing valve (10) is aligned approximately perpendicularly to the mixer spindle (3').

6. Double-cone rotating mixer according to claim 1, characterized in that there is a lockable outlet device (17) in the bottom part of each half-container (14,14').

* * * * *